US005144770A

United States Patent [19]

Kraus et al.

[11] Patent Number: 5,144,770

[45] Date of Patent: Sep. 8, 1992

[54] WINDOW OPERATOR

[76] Inventors: Kenneth Kraus, 17 Elizabeth Pl., Armonk, N.Y. 10504; Edward J. Page, 454 Crestwood Ave., Hackensack, N.J. 07601

[21] Appl. No.: 570,929

[22] Filed: Aug. 21, 1990

[51] Int. Cl.[5] ..... E05F 11/00

[52] U.S. Cl. ..... 49/360; 49/362

[58] Field of Search ..... 49/360, 362, 361, 352; 474/140, 101

[56] References Cited

U.S. PATENT DOCUMENTS

| | | | |
|---|---|---|---|
| 1,152,425 | 9/1915 | Lovell . | |
| 1,271,717 | 7/1918 | Kaufmann | 474/140 |
| 1,590,473 | 6/1926 | Miller | 49/361 X |
| 1,854,419 | 4/1932 | Neuhausen . | |
| 2,012,386 | 8/1935 | Genberg . | |
| 2,026,119 | 12/1935 | Benzenberg | 20/42 |
| 2,399,109 | 4/1946 | Geer et al. | 160/28 |
| 2,545,449 | 3/1951 | Curley | 268/122 |
| 2,649,301 | 8/1953 | Signore | 49/361 X |
| 3,022,065 | 2/1962 | Martin | 49/362 |
| 3,152,368 | 10/1964 | Stuart | 49/362 X |
| 3,324,594 | 6/1967 | Hettinger et al. | 49/362 X |
| 4,020,593 | 5/1977 | Salomon et al. | 49/352 X |
| 4,306,378 | 12/1981 | Fukura et al. | 49/352 |
| 4,353,185 | 10/1982 | Saigne | 49/352 X |
| 4,660,325 | 4/1987 | Bauer et al. | 49/352 |
| 4,793,099 | 12/1988 | Friese et al. | 49/352 X |

*Primary Examiner*—Philip C. Kannan

*Attorney, Agent, or Firm*—Carl C. Kling

[57] ABSTRACT

A window operator, located at one side of the window, opens or closes the sash without jamming. The operator includes three structural extrusions:
the track, of rectangular cross-section;
the traveler, of H-cross-section; and
the crank housing, of seven-sided cross-section.

The track is roughly equivalent to the window opening height in length, and has a longitudinal gap with smoothed edges. The crank housing, open at the base, has two sides angled to the vertical so as to present parallel faces for mounting the crankshaft, and has three screw bosses. The track has locating holes providing a location at the top for an idler pulley, has an interior side routed out at the base to accept the sprocket, and has an exterior location at the base for a sprocket shaft bearing. A sprocket shaft and sprocket are mounted within the track. A toothed belt about the sprocket and the idler pulley is driven by a sprocket shaft and is attached to a polyvinyl chloride H-cross-section traveler captured by the gap in the track. The belt, essentially without tension, is held wrapped about the sprocket by a simple bobbins-and-rings constraint assembly. The traveler, of about sash length, is attached to the sash by angle clips, and to the belt by a simple captured stud. The sprocket shaft is operated by a worm gear set, with advantage, which moves the shaft, sprocket, belt, traveler and sash.

19 Claims, 6 Drawing Sheets

WINDOW OPERATOR

BACKGROUND OF THE INVENTION

1. Field of the Invention

The invention relates to operators for slidable windows such as double-hung windows, and more particularly relates to a handcrank-operated power transmitting window operator which can be retrofitted on an existing window or included in a new window installation, at the side, out of view.

2. Description of Related Art

Double-hung windows predominate in residential and small business structures built during the past hundred years. In the classic double-hung window, there is an upper sash and a lower sash separated by a wooden strip so as to slide independently of each other. The upper sash is usually outside, to shed water. Upper sash and lower sash are independently counterbalanced by weights cord-supported over pulleys in the window frame. Wooden double-hung windows in many older structures are reaching their limits of age. Many are being replaced by aluminum sashes mounted in channels to fit where the older wooden sash was allowed to slide. Double-hung aluminum windows typically tilt in for washing; they are held within the channels by lateral extensions which are moved out of the channel to allow tilting. The replacement window may have spring counterweights within the channels. The replacement window is expected to fit more closely than the wooden sash ever did, to fulfill modern temperature control requirements. This tighter fit, and the absence of free-running counterweights, can make the replacement window difficult to operate.

A window operator technology was developed during the heyday of the wooden sash double-hung window, to control easy raising and lowering, locking and access for washing or repair. Exemplary of this technology the following: U.S. Pat. No. 1,152,425, Lovell, WINDOW OPERATING APPARATUS, Sep. 7, 1915, provides a geared crank at the base of the window. The crank turns a base shaft which through bevel gears turns a pair of vertical spiral worm shafts, one worm shaft on each side of the window, for each sash. There are four vertical worm shafts for each double-hung window. Turning the crank opens or closes both top and bottom sashes equally and simultaneously.

U.S. Pat. No. 1,271,717, Kaufman, BELT GUARD, Jul. 9, 1918, shows a belt guard for a fan belt in a Model T Ford. The belt guard constrains the belt within a rectangular opening as a guide to keep the belt from flopping off its pulleys.

U.S. Pat. No. 1,590,473, Miller, WINDOW OPERATING APPARATUS, Jun. 29, 1926, shows a balanced cable-drive window operator. Cable spools at each side of the double-hung window are crank-operated to raise the bottom sash and lower the top sash simultaneously.

U.S. Pat. No. 1,854,419, Neuhausen, WINDOW CONSTRUCTION, Apr. 19, 1932, shows a mechanism permitting a double-hung window to be opened normally, or to be swung open for cleaning or repair.

U.S. Pat. No. 2,012,386, Genberg, SLIDING WINDOW, Aug. 27, 1935, shows a mechanism for holding top and bottom sashes aligned in the same plane when the window is closed, offsetting the top and bottom sashes to open the window.

U.S. Pat. No. 2,026,119, Bentzenberg, WINDOW CONSTRUCTION, Dec. 31, 1935, also shows mechanism to offset upper and lower sashes.

U.S. Pat. No. 2,399,109, Geer, WINDOW, Apr. 23, 1946, shows a unit window in which the operator mechanism, a crank-driven rack and pinion gear set, is factory installed, with mechanism to move the window sash laterally away from its mating window sash for easier operation.

U.S. Pat. No. 2,545,449, Curley, OPERATING MECHANISM FOR A WINDOW AND CASING ASSEMBLY, Mar. 20, 1951, shows crank-operated horizontal shaft power train bevel-gear-connected to a pair of worm gears which operate the window sash.

U.S. Pat. No. 2,649,301, Signore, WINDOW SASH OPERATING MECHANISM, Aug. 18, 1953, shows a crank-operated horizontal shaft and balanced rack and pinion gear sets to operate the window sash.

U.S. Pat. No. 3,022,065, Martin, POWER APPARATUS FOR WINDOWS AND THE LIKE, Feb. 20, 1962, shows control mechanisms for connecting a motor to a drive rod for operating a double-hung window.

U.S. Pat. No. 3,152,368, Stuart, SLIDING WINDOWS WITH OPERATORS THEREFOR, Oct. 13, 1964, shows a crank-operated mechanism for operating sliding windows by a rack and pinion gear set.

U.S. Pat. No. 3,324,594, Hettinger et al, POWER APPARATUS FOR WINDOWS OR THE LIKE, Jun. 13, 1967, shows a motorized rack and pinion mechanism for positioning the sash directly.

U.S. Pat. No. 4,020,593, Salomon et al, WINDOW WINDING APPARATUS FOR VERTICALLY DIVIDED AUTOMOBILE SLIDING WINDOW PANES, May 3, 1977, shows a constrained cable which moves connector studs within slide channels attached to both the small triangular window and larger window on a front door, to operate the triangular window and the larger window simultaneously as the respective connector studs follow descending and ascending loops.

U.S. Pat. No. 4,306,378, Fukura et al, WINDOW REGULATOR FOR AUTOMOTIVE VEHICLES, Dec. 22, 1981, shows an auto window mounted in a guide rail set and operated by a reciprocal wire over pulleys above and below the limit of travel for the connection between wire and window.

U.S. Pat. No. 4,353,185, Saigne, WINDOW RAISER, Oct. 12, 1982, shows a screw jack for an automobile window, in which two crossed arms are fixed to the window and to a wormscrew at their crossing, with free ends sliding in a horizontally fixed channel; the jack is in X configuration which collapses or extends to lower or raise the window.

U.S. Pat. No. 4,660,325, Bauer et al, FLEXIBLE WINDOW REGULATOR ASSEMBLY, Apr. 28, 1987, shows a balanced stiff tape system to deliver rotary power with mechanical advantage to a reciprocating window. The tape carries rotary motion from a motor or crank operated drum to a reciprocating reach of tape between rounded guides so that there is a reach of tape in line with and coextensive to the travel of the window. The window is connected to the tape by a carrier plate which has jaws to clamp it to the tape, which drives the window up or down.

U.S. Pat. No. 4,793,099, Frieze et al, TAPE DRIVEN POWER WINDOW MODULE, Dec. 27, 1988, shows a replacement module for a fixed rear window of a pickup truck. The replacement module adds the feature of opening of the window, with both window and operating mechanism included in the module. The window is balanced by resilient bands which overcome the weight and friction of the window to keep the window relatively weightless. The window is raised and lowered by gear driven balanced slotted tapes which pull down or push up the window under urging from a crank or motor. Tapes are constricted in channels to keep the tapes from collapsing when actually pushing the window up. The tape either permits the window to rise under urging of a positive counterbalance force, or actually pushes the window sash upward, the tape being constrained in a tight channel.

The prior art thus shows simple and complex techniques for crank operation of double-hung or other slidable windows, generally using a balanced approach with lifting power applied equally to each side of the sash. The prior art, however, has not solved window operator problems inherent in the window replacement market, in which the wooden sash sliding easily on counterweights is replaced by an aluminum sash with spring or friction operation. The prior art has not fully dealt with the problems of retrofitting a window operator onto an existing wooden or aluminum sash.

SUMMARY OF THE INVENTION

The object of the invention is to provide a mechanically-advantaged window operator for an existing window, whether original or replacement, whether counterweighted or otherwise supported, and whether small or large.

A feature of the invention is an elongated traveler which transmits to the window sash, while resisting rotation of the sash, the lifting power from a crank mechanism via a toothed belt and via a simple wrap connection.

A feature of the invention is its one-side installation, outside the view of the window, and outside the tilt path of a tiltable window. Either-side and both-side installations are easily derived by using the mirror image.

Another feature of the invention is a simple pulley wrap constraint which eliminates the need for belt tensioning.

An advantage of the invention is its one-hand operation.

The principal advantage of the invention is its simplicity, which makes for easy manufacturability, easy installability, and easy accessibility for cleaning and repair.

Another advantage of the invention is its use of catalog components in the crank drive, and of simple extrusions and stampings for the structural parts, plus a simple toothed belt and sprocket arrangement.

Another advantage of the invention is its installation at the side of the sash, with easy-release fasteners, permitting an unhampered view and also permitting unblocking the window as an emergency exit, yet being easily covered by curtains.

Still another advantage of the invention is that it can operate a window where lifting leverage is compromised by deep sills or other awkward access.

Still another advantage of the invention is that it may be manufactured in a very few simple variations of size and position, yet be customizable in the field to the exact window dimensions.

Other objects, features and advantages of the invention will be apparent from the following detailed description of a preferred embodiment.

BRIEF DESCRIPTION OF THE DRAWINGS

FIGS. 9–10 are respectively front and side semidiagrammatic views of a simple ring belt wrap constraint. FIGS. 11–12 are semidiagrammatic presentations of a spools-and-rings belt wrap constraint. FIG. 13 is a simplified view of two additional configurations of spools for use in a spools-and-rings belt wrap constraint. FIG. 14 is a simplified diagram of the belt and sprocket system with spool-and-rings belt wrap constraint and with beltloop-on-stud connection for the traveler.

FIG. 15 is a front elevation; FIG. 16 is a plan view; FIG. 17 is a side elevation of the crankshaft housing with worm gear set in place, showing thrust bearings; FIG. 18 is a side elevation which shows the interior relief of the track, which permits insertion of the sprocket.

DESCRIPTION OF A PREFERRED EMBODIMENT

Figure 1:
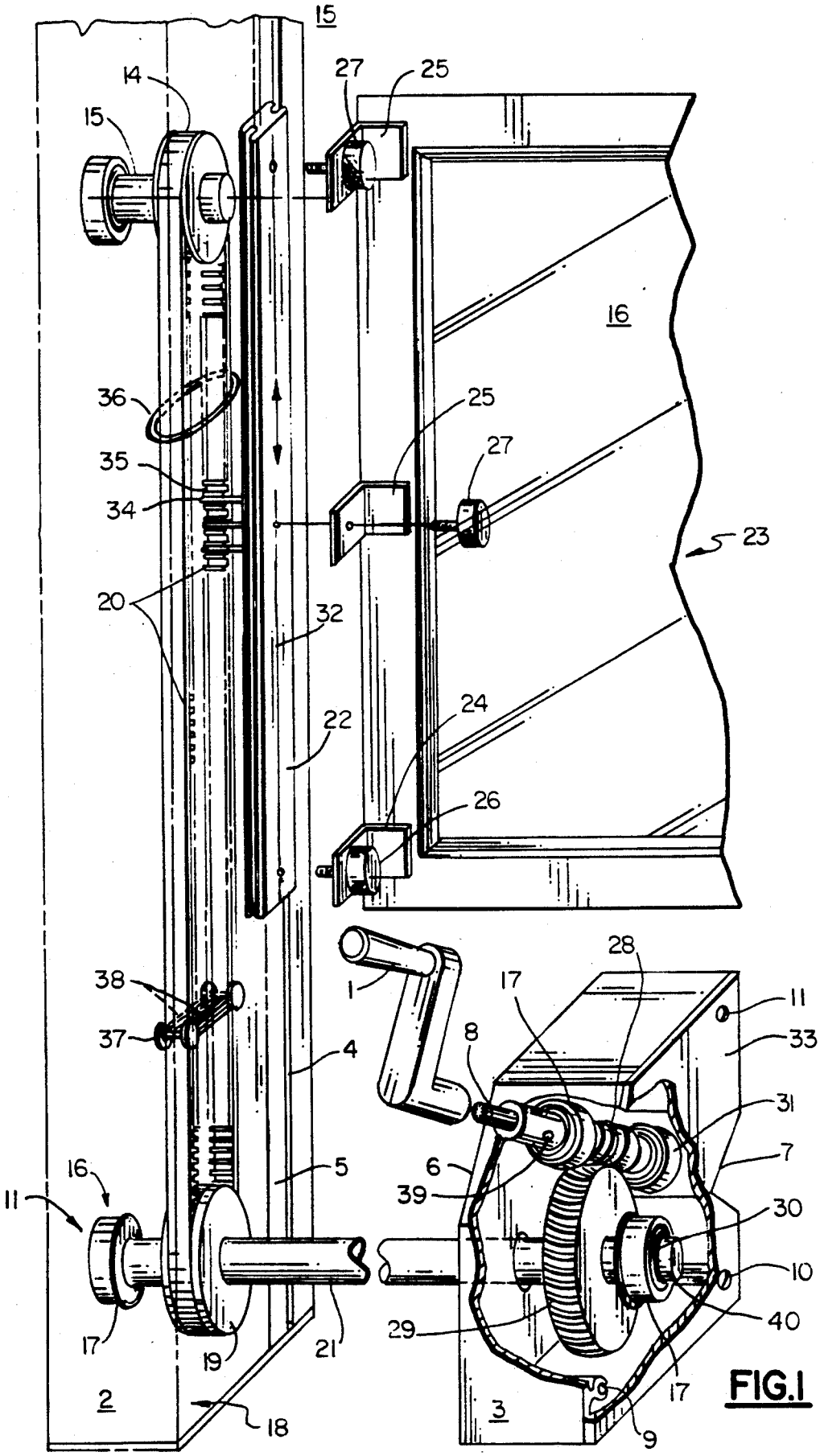
FIG. 1 is a partially exploded partially cutaway general descriptive drawing of the invention.

FIG. 1 shows a window operator, for a double-hung window, which provides selective opening or closing force from a small handcrank. The window operator, a simple but effective device, operates at one side of the window, but transfers force to the window only in the direction of window travel. The window operator provides force only in the direction of window travel so as not to rack the window sash and cause jamming. The window operator includes a simple, relatively standard handcrank mechanism including a worm gear set which transfers power from the handcrank to a slide for operating the window. Support for the traveler and the handcrank mechanism is by two structural members, a track and a crankshaft housing. The structural members are configured as extrusions, for economy and ease of assembly.

Handcrank 1 may be identical to handcranks used with casement windows, small and inexpensive. Track 2, of narrow rectangular cross-section, extends vertically from its base end, along the side of the interior window frame, to its distal end at the top of the window frame. The inside of the track forms a sprocket and belt chamber. Crank housing 3, of seven-sided cross-section, is mounted at the base of the track 2 and affixed to track 2.

Track 2 has a standard length roughly equivalent to the height of the overall window opening. It has a longitudinal gap of uniform length, with gap edges 4–5 rounded to a smooth configuration. The crankshaft housing 3 is open at the base, and has two crank bearing angled faces 6–7 at 30 degree angles to the vertical. The crank bearing angled faces present parallel faces for mounting the crankshaft 8. The crankshaft housing extrusion 3 also has three screw bosses 9. Only one screw boss can be seen in FIG. 1, but screw heads 10 identify their locations. Screws 10 may be self-tapping metal screws or other ordinary fasteners, identified generally by reference character "10. " Track 2 has a sprocket shaft locating hole 11 at its exterior base. Track 2 also has idler pulley shaft locating holes 12, providing a location at the top for an idler pulley shaft 13 and idler pulley 14. Idler pulley shaft 13 may be a self-threading bolt with a smooth shaft.

Track 2 may be mounted to a window frame 15 by self-threading screws 10, which may be accessed via the gap in the track, with the traveler moved out of the way. A preferred mounting is top-and-bottom, by brackets or screws below sprocket 19 and above idler pulley 14. Crank housing 3 may be factory-welded to track 2 or may be affixed by self-threading screws 10. Sprocket shaft locating hole 11, at the exterior base of track 2, is fitted with a sprocket shaft bearing 17. Track 2 has at its interior base a large relief opening (18) in the interior to accept assembly of the sprocket 19 and belt 20. A sprocket shaft 21, with toothed sprocket 19, is mounted within the track 2. Belt 20 is a toothed belt about the sprocket 19 and the idler pulley 14.

Belt 20 is driven by the sprocket shaft 21 and is attached to a polyvinyl chloride H-cross-section traveler 22 captured by the rounded edges 4–5 of the gap in the track 2. The traveler 22 is in length comparable to the length of the sash 23. It is attached to the sash 23 by angle clips 24–25, respectively held by knurled handscrews 26–27 near top and bottom of the sash 23. The sprocket shaft 21 is operated by a worm gear set 28–29. The worm gear set 28–29 transmits with advantage the power of the crank 1 to the sprocket shaft 21. Sprocket shaft 21 turns the sprocket 19 to move the belt 20 and cause the traveler 22 to move up or down. Both sprocket shaft 21 and crankshaft 8 are preferably mounted in flanged "OILON" permanently lubricated plastic bushings 17. The flanges are placed toward the housing center at both ends of their respective shafts. The shafts may be held in place by E-clips 30 as necessary, but a preferred technique is to have top-hat-shaped flanged bearings which fully enclose the ends of their respective shafts, except of course for the crank end of the crankshaft. The shaft length dimensions are controlled so that the flanges of the bushings 17 bear against the walls of their respective housings and against pulleys or gears of their respective mechanisms to serve as thrust bearings and also as lubricant sealing assembly devices. The bearings provide to the preferred embodiment not only the thrust resistance required, but also precision, ease of operation, and economy both in bearing cost and in assembly cost.

To operate the window, the person simply turns the crank 1 to move the traveler 22 and the attached sash 23 up or down. The mechanical advantage of the worm gear set 28–29 acts as an effective lock on the window when the sash 23 is closed. The window operator acts as an effective low-security lock for the window in any open position or closed position.

A variant from the vertical mounting of the track is a horizontal mounting, for a sliding window.

Another variant is to extend sprocket shaft 21 all the way across the window, and have a second track on the opposite side, for a balanced operation where the sash cannot accept the one-sided drive force. The sides are mirror images of each other so far as track and crank housing are concerned; the travelers and crank mechanisms may be mirror images or may be identical. Once the determination has been made to manufacture a mirror image window operator, it becomes easy to postulate left installation or right installation.

FIG. 1 shows or implies all components of the window operator. These components will be further discussed with respect to other figures. The crankshaft housing 3 is equipped with crankshaft locating holes (31, implied in FIG. 1) in drill-locating valley 32. The drill-locating valley in the extrusion forming crankshaft housing 3, and other drill-locating valleys 32 in traveler 22, are useful in easy drilling of precision holes without the need for expensive fixtures or extra effort. Crankshaft housing cover 33 not only encloses working parts but serves as assembly completion and axle support at its sprocket shaft locating hole (11, implied in FIG. 1).

FIG. 1 also shows generally the locations of belt 20 attachment and belt-wrap control mechanisms, including captured-stud connection (34, implied in FIG. 1), stud 35, pulley wrap control 36, wrap control bobbins 37 and bobbin rings 38, pin 39 and E-clip groove 40. These items will be further discussed with respect to other figures.

Figure 3:
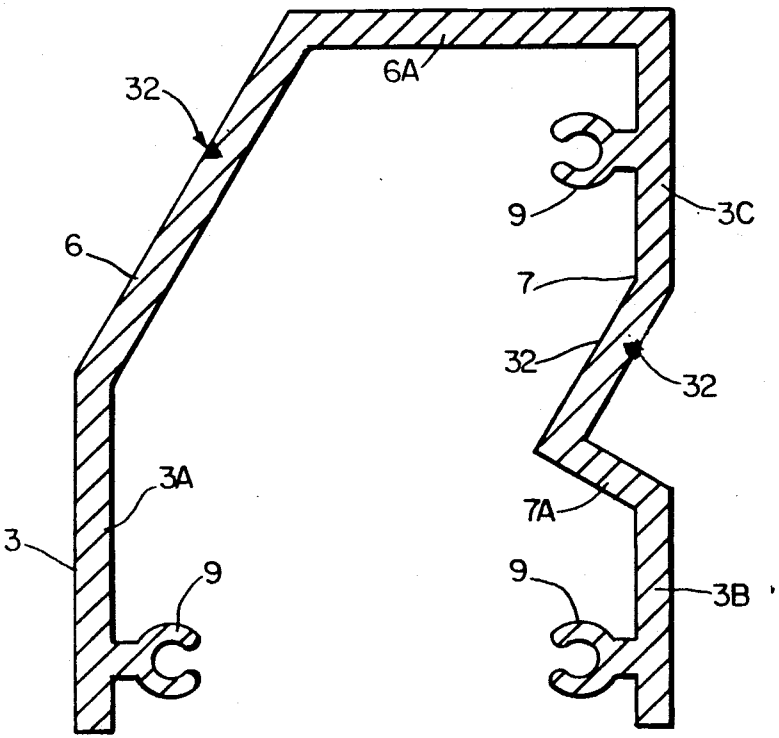
FIG. 3 is a side elevation view (cross-section) of the crankshaft housing extrusion.
Figure 2:
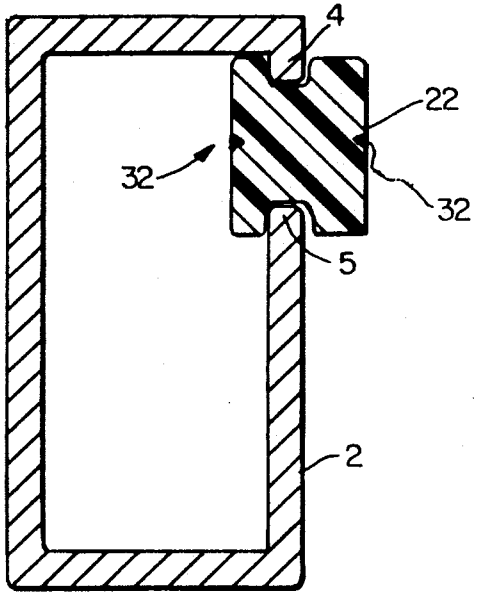
FIG. 2 is a top view (cross-section) of the track extrusion with traveler extrusion in place.

FIGS. 2–3 show the extrusions for track 2, for traveler 22 and for crankshaft housing 3 in cross-section. Traveler 22 is captured slidably by rounded gap edges 4 and 5 of track 2. Traveler 22 preferably is polyvinyl chloride plastic, extruded with drill locating valleys 32. Track 2 and crankshaft housing 3 preferably are aluminum metal.

FIG. 3 shows the crankshaft housing extrusion. Screw bosses 9 are positioned to accept mounting screws 10 for the crankshaft housing cover. Drill-locating valleys 32 are included in the extrusion. This permits the drilling of a crankshaft locating hole (not shown in FIG. 3) through each of the two angled sides of the extrusion, a savings in expense and effort of manufacture. The extrusion is of indeterminate length, having, in cross section, a base plane defined by the bottoms of the two rising sides next to the open bottom, a top and six sides. The six sides include first, second and third rising sides 3A, 3B, 3C, perpendicular to the base plane, with the first rising side 3A being adjacent to the base plane and of greater height than that of the second rising side 3B, which also is adjacent to the base plane, opposite the first rising side. A first angled side extends from the first rising side 3A to the top 6A. The first angled side 6 is at a non-normal angle to the base plane, the top 6A being essentially parallel to the base plane. There is a second angled side 7, parallel to the first angled side 6, the first and second angled sides being non-parallel to the base plane, at a convenient angle (30 degrees from vertical preferred) for easy access to the crank. There is also a third angled side 7A, connecting the second angled side 7 to the second rising side 3B, thereby forming a chamber adapted to house a shaft mounted normal to the first and second angled sides 6–7.

Figure 4:
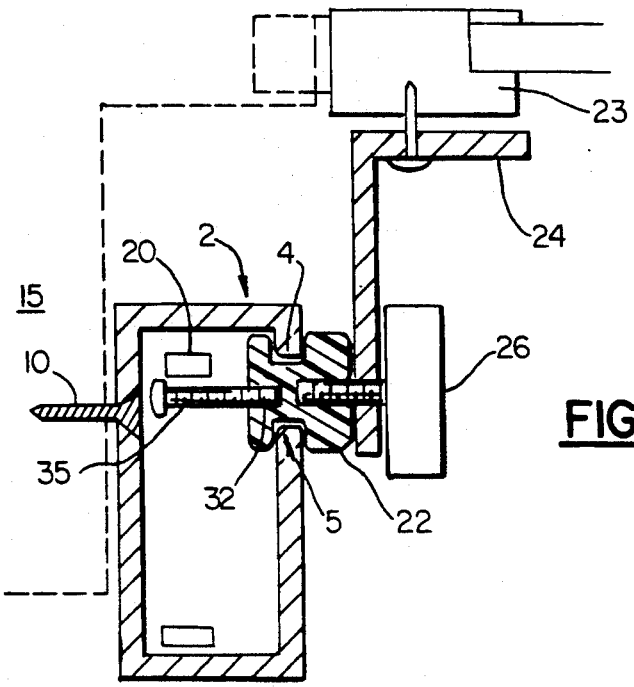
FIG. 4 is a plan view, similar to FIG. 2, of the track with belt in place, showing the stud which is the preferred connection to the traveler.

FIG. 4 shows the track and traveler assembled. The smoothly configured edges 4 and 5 of the gap in track 2 hold traveler 22, which also has drill-locating valleys 32. Handscrews and angle clips join traveler 22 and the sash 23 together as a unit. There is very little component of force other than up and down; that is, there is very little jamming rotation. Traveler 22 is affixed by handscrew 26 to angle clip 24, which is in turn affixed to sash 23. Sash 23 moves with traveler 22, while track 2 is affixed to window frame 15 via screw 10. Traveler 22 is extruded from tough plastic, with drill-locating valleys 32. Such drill-locating valleys are also included in the crank bearing faces 6, 7 of crank housing 3. The drill-locating valleys 32 aid in positioning the locating holes 31. A drill bit inserted into one of the drill-locating valleys 32 is much less susceptible to bending or breakage than it would be if it approached a flat surface. The drill point in the drill-locating valley needs only lateral support in the direction of the valley, and less of such lateral support than it would otherwise require.

Figure 5:
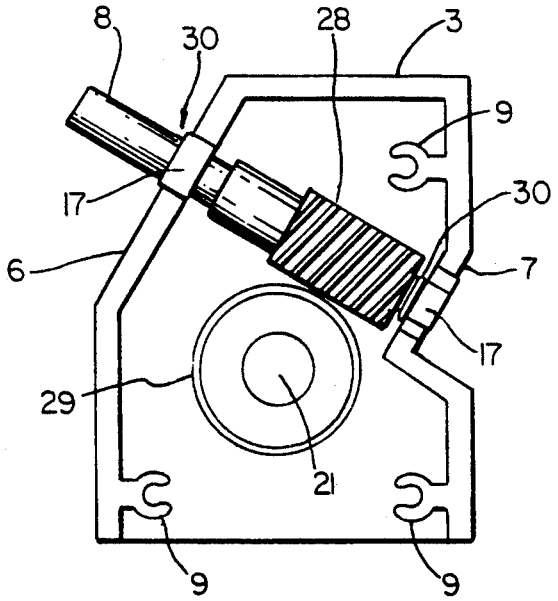
FIGS. 5–6 show the preferred details of crankshaft housing and crankshaft housing cover as assembled with worm gear set in place.

FIG. 5 shows in cross-section the extrusion for the crank housing 3, crankshaft 8, sprocket shaft 21, and worm gear set 28,29. Worm gear 28 is pinned to crankshaft 8. Crankshaft 8 is mounted in crankshaft bearings 17 and held by E-clips 30. The crankshaft bearings 17, are set in locating holes 31 which are cut into crank bearing faces 6, 7.

Figure 6:
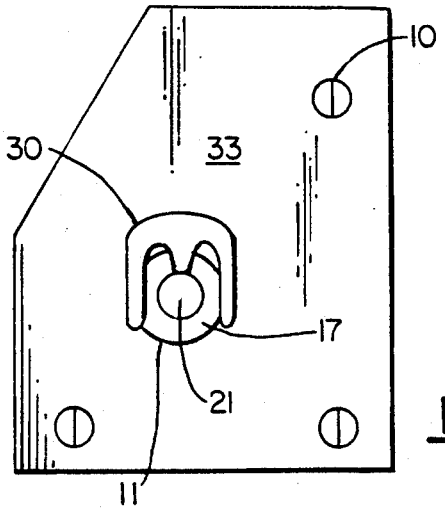

FIG. 6 shows the crankshaft housing cover 33. Cover 33 has a locating hole 11 for sprocket shaft 21. Sprocket shaft 21 is turned with an E-clip groove cut about its circumference at each end. E-clips 30 at both ends of crankshaft 8 serve to lock crankshaft 8 in place. As preferred variants, bearings 17 can be thrust bearings, and worm gear 28 can be configured the same length as the internal space between crank bearing faces 6 and 7. The shaft is inserted within the housing while worm gear and shaft are unpinned. Once assembled, the worm gear is pinned in place, its shoulders forming the thrust bearing followers. The need is for some type of thrust-bearing means to keep the worm gear from moving longitudinally as it turns.

Figure 7:
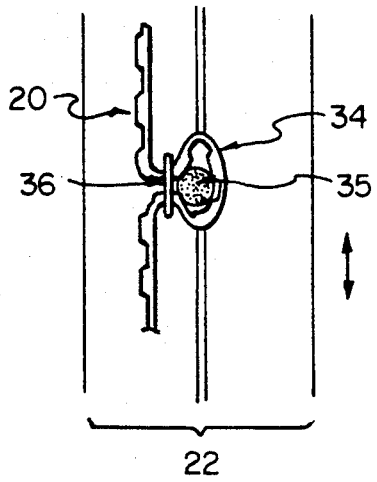
FIGS. 7–8 show the preferred belt-wrap-on-stud connection of belt to traveler.
Figure 8:
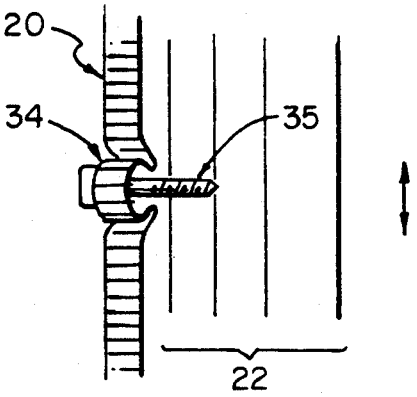

FIGS. 7–8 show how belt 20 in the preferred embodiment is locked onto the traveler by simply wrapping the belt about a stud 35 screwed into traveler 22 at the drill-locating valley 32, the wrap being locked by a fastener 36 which preferably is a resilient O-ring.

Figure 9:
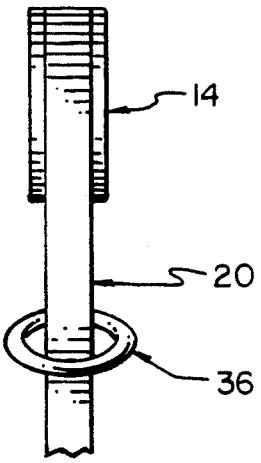
FIGS. 9–14 show the belt wrap constraint which holds the drive belt in place on sprocket and idler pulley.
Figure 10:
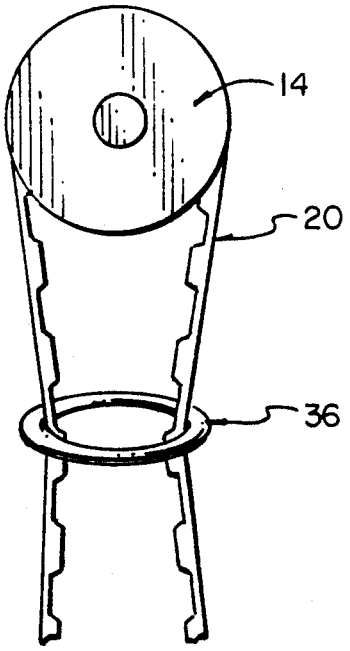
Figure 11:
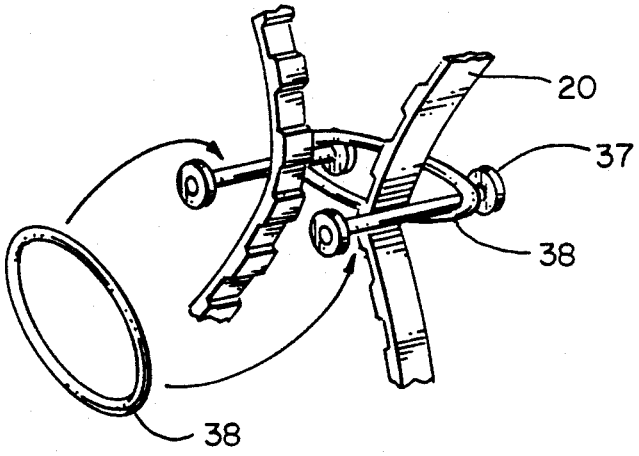

FIGS. 9–14 show a preferred embodiment, using spools-and-rings (rather than the simple fastener 36 as shown in FIGS. 9–10) as a sprocket wrap constraint. Two wrap-control bobbins 37 are used to constrain the belt 20. Two resilient rings 38 are slipped over the wheel ends of the bobbins 37; bobbins 37 are able to roll and slip as the belt moves, but do not cause wear of the belt 20. The flanges on the bobbins 37 hold the bobbin rings 38 in place between belt 20 and flange.

Figure 12:
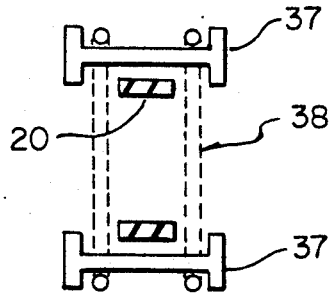
Figure 13:
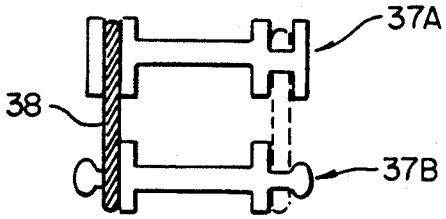

FIGS. 12 and 13 show three differing configurations of bobbin 37. FIG. 13 shows the double-flange bobbin 37A, and the flange-and-knob bobbin 37B. The choice of bobbin is for ease of assembly and to protect the bobbin rings 38 from wear in high-use situations.

Figure 14:
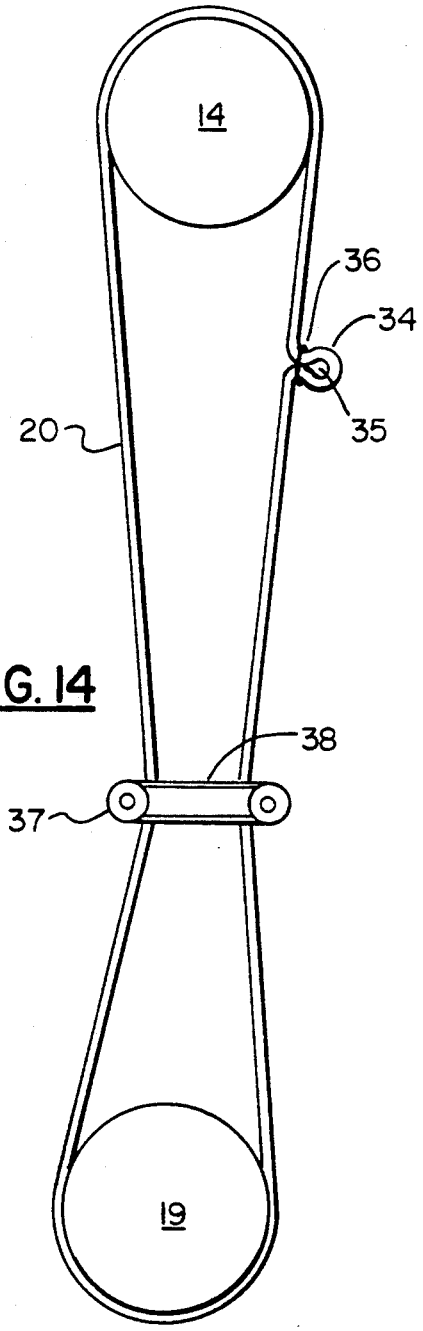

FIG. 14 shows the captured-stud connection 34 of belt 20 to the traveler. The assembler merely makes a loop with a resilient ring 36 and connects by placing the loop over stud 35. FIG. 14 also shows the bobbins-and-rings belt wrap constraint assembly about sprocket 19. The constraint assembly holds belt 20 looped about sprocket 19; the constraint increases slightly as the belt moves up on one side and down on the other, helping to wrap the toothed belt 20 more completely about sprocket 19 and idler pulley 14. The constraint assembly may drift downward as a result of gravity, slightly increasing wrap, but generally finds an appropriate niche and stays put, moving slightly as the belt moves, but returning as the belt returns.

FIGS. 15–18 show the assembly of track and crankshaft housing in greater detail.

Figure 15:
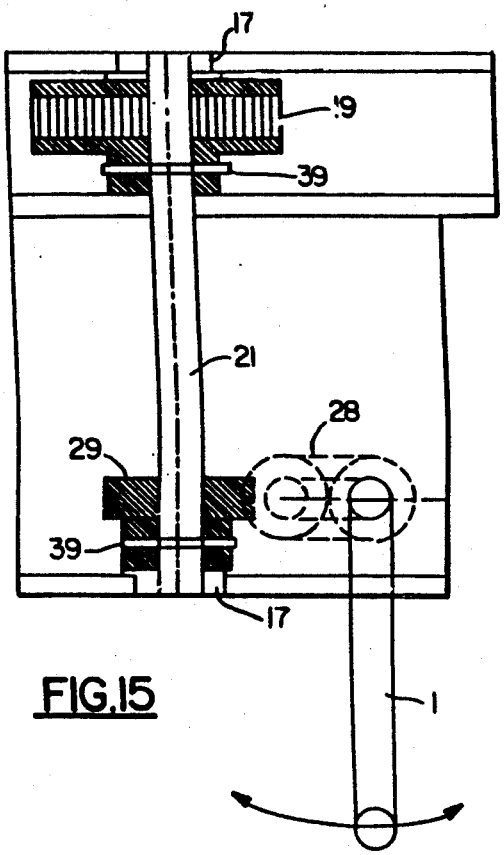
FIGS. 15–18 show the assembly of track and crankshaft housing.

FIG. 15 shows how parts on sprocket shaft 21 are constrained within track 2 and crankshaft housing 3 once assembled and pinned by pins 39.

Figure 16:
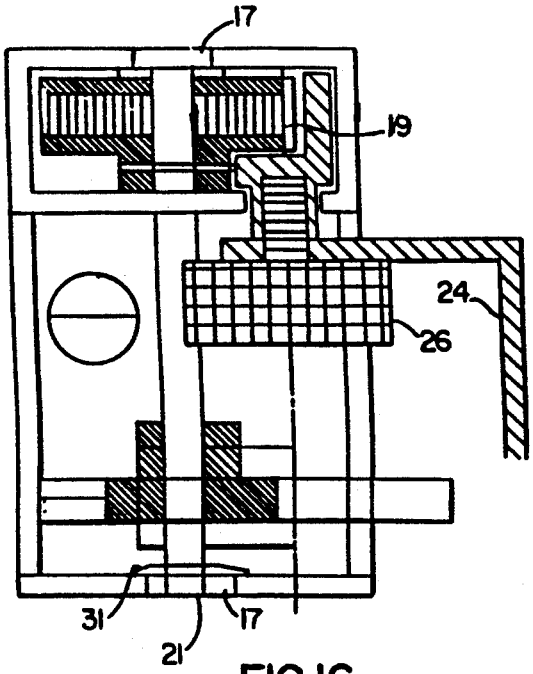

FIG. 16 shows a variant of traveler configuration 22A in which the traveler is not in H-configuration but is modified to fit within track 2 for greater strength.

Figure 17:
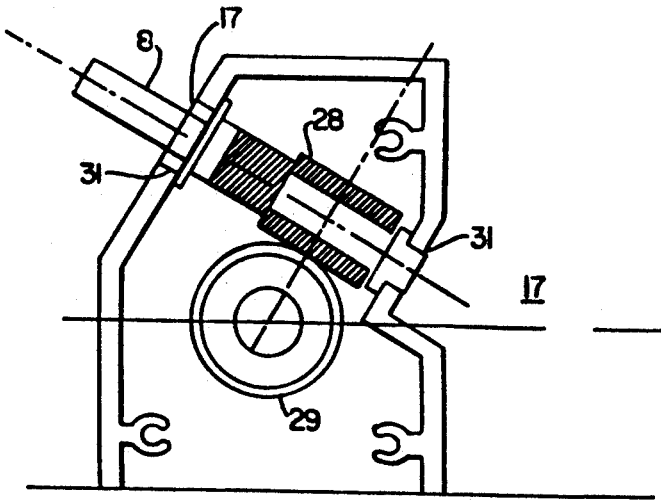

FIG. 17 shows details of crankshaft housing with crank and worm gear parts in place.

Figure 18:
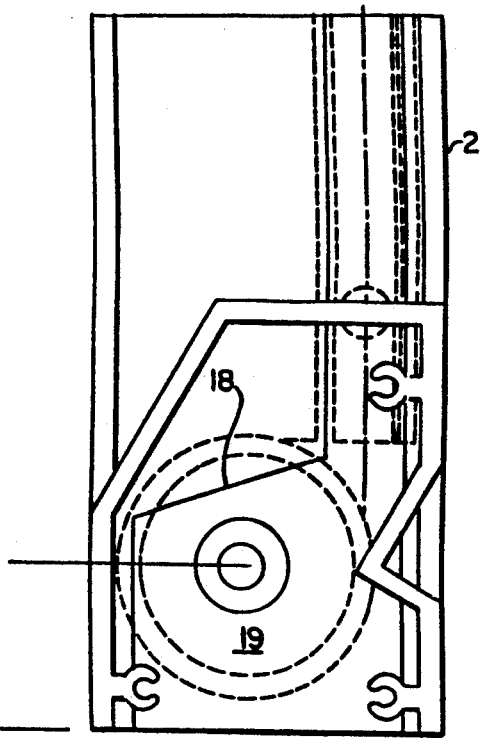

FIG. 18 shows how sprocket 19 is held in place after being installed within opening 18 of track 2, and shows how traveler 22 is related.

When installed in the window, track 2 may be supported in a variety of ways depending upon the configuration of the window opening, but top and bottom fastening is preferred. The crankshaft housing can be extended the entire width of the window opening if the window is very wide or very heavy, with a second track 2 and belt 20 carrying a second sprocket 19 on an extended sprocket shaft 21.

While the invention has been shown with respect to a single embodiment with only a few suggested variants, other variations will be apparent to those skilled in the art and yet fall within the spirit and scope of the invention, as defined in the claims which follow.

We claim:

1. A window operator, for a window having an opening filled by one or more slidable sash units characterized by (a) a track (2) of length similar to that of the window opening, having a generally closed configuration sprocket and belt chamber relieved by a longitudinal gap of defined dimension and smoothly configured gap-defining edges (4,5), the track having a base end and a distal end opposite said base end;

(b) a traveler (22) of general H-configuration captured slidingly in the defined gap of said track (2) and attachable to a window sash (23);

(c) an idler pulley (14) mounted near the distal end of said track (2), to rotate in a plane generally perpendicular to the sash of said window;

(d) a sprocket and belt set (19,20) mounted within said sprocket and belt chamber of said track (2), said sprocket and belt set (19,20) including a sprocket pulley (19) mounted near the base end of said track (2), to rotate within the sprocket and belt chamber of said track (2) in general alignment with said idler pulley (14), rotationally locked onto a sprocket shaft (21) which is supported for easy rotation by a bearing (17) on the exterior of said track (2) and extends through an assembly opening to the outside of said track (2);

(e) means mounting said traveler (22) to the sash (23) of said window;

(f) a crankshaft housing (3) mounted adjacent said track (2) to form a worm gear mechanism and sprocket chamber for said sprocket shaft (21) and its related gears (19,28,29), being an extrusion section having a base and seven sides, two of which form parallel crankshaft bearing faces (6,7) and have locating holes (31,32) for crankshaft bearings (17), and having a plurality of screw bosses (9);

(g) means mounting a crankshaft (8), with worm gear set (28,29) and one or more thrust bearings (17)

holding said crankshaft longitudinally within said worm gear mechanism and sprocket chamber;

(h) crankshaft housing cover (33) providing location and thrust support for sprocket shaft (21) bearing (17), and (i) means mounting said crankshaft housing (3) to said track (2);

whereupon rotation of said crankshaft (8) provides via said worm gear set (28,29) and sprocket and belt set (19,20) a selective sliding motion to traveler (22) and to sash (23).

2. A window operator according to claim 1, wherein said worm gear set includes permanently lubricated thrust bearings.

3. A window operator according to claim 1, wherein said crankshaft housing (3) and said track (2) are assembled together with said sprocket shaft, belt and sprocket (19) in place, said track having an opening (18) sufficient for entry of said sprocket.

4. A window operator characterized by (a) a track (2) having a longitudinal gap;

(b) a traveler (22) of elongated configuration slidably mounted in the gap of said track (2);

(c) a belt (20) mounted within said track (2) and attached to said traveler (22) so that motion of said belt causes sliding motion of said traveler (22);

(d) sprocket drive means, attached to said track (2), for said belt (20);

(e) a crank operable worm gear set arranged to drive said sprocket drive means in response to turning of crankshaft (8); and (f) attachment means (24–27) to form a rigid attachment of said traveler (22) to a window sash;

whereby turning of a crank to operate said crank operable worm gear set opens and closes any attached window sash.

5. A window operator according to claim 4, wherein said traveler (22) is an elongated plastic extrusion essentially in cross section configuration of a capital H with a thick crossbar, and said track (2) is an essentially closed extrusion with a gap, the gap having smoothly configured edges to fit within the uprights of the H of said traveler (22) to make slidable contact with the crossbar of said traveler (22), so that traveler (22) slides resisting rotation.

6. A window operator according to claim 5, wherein said traveler (22) plastic is polyvinyl chloride.

7. A window operator according to claim 4; wherein said crank operable worm gear set is housed in extruded base (3) which is a section of an extrusion having an open base and seven planar sides, two of which planar sides being parallel and at an angle to the horizontal, and having drill-locating valleys defining a drill position for crankshaft locating holes with axes falling within a plane including both drill-locating valleys and perpendicular to said angled parallel planar sides.

8. A plastic extrusion in H-configuration in cross-section, of indeterminate length, in cross-section having two longer side portions corresponding to the uprights of the H, connected by a central portion corresponding to a thick crossbar of the H, one longer side portion being thicker than the other, having drill-locating valleys at an intermediate position on the exterior of said H-uprights.

9. An extrusion of indeterminate length, having, in cross section, means defining a base plane, a top and six sides, including first and second rising sides, perpendicular to and adjacent said base plane, with the first of said rising sides being of greater height than that of said second rising side, a first angled side extending from said first rising side to said top, said first angled side being at a non-normal angle to said base plane, the top being essentially parallel to said base plane, a second angled side parallel to said first angled side, said first and said second angled sides being non-parallel to said base plane, a third rising side connecting said top to said second angled side, and a third angled side connecting said second angled side to said second rising side, thereby forming a chamber adapted to house a shaft mounted normal to said first and second angled sides.

10. An extrusion according to claim 9, wherein the material is aluminum, and wherein said first, second and third rising sides are equipped with screw bosses.

11. An extrusion according to claim 9, wherein said first and second angled sides are each equipped with a drill-locating valley.

12. A belt wrap constraint assembly for a toothed belt, comprising a pair of bobbins, opposed to each other across a bight in the belt about a sprocket, and a pair of resilient rings holding said pair of bobbins in tension across the bight of the belt.

13. A window operator characterized by (a) a track (2) having a longitudinal gap;

(b) a traveler (22) of elongated configuration slidably mounted in the gap of said track (2), said traveler (22) being equipped with a stud (35);

(c) a belt (20) mounted within said track (2) and attached to said stud (35) by a loop (34) in said belt (20), said loop (34) being defined by resilient fastener (36), so as to capture said stud (35) so that motion of said belt causes sliding motion of said traveler (22);

(d) sprocket drive means for said belt (20);

(e) a crank operable worm gear set arranged to drive said sprocket drive means in response to turning of a crankshaft (8); and (f) attachment means (24–27) to form a rigid attachment of said traveler (22) to a window sash;

whereby turning of a crank to operate said crank operable worm gear set opens and closes any attached window.

14. A window operator characterized by (a) a track (2) having a longitudinal gap;

(b) a traveler (22) of elongated configuration slidably mounted in the gap of said track (2);

(c) a belt (20) mounted within said track (2), and directed around an idler pulley (14) mounted near the distal end of track (2), and attached to said traveler (22) so that motion of said belt causes sliding motion of said traveler (22);

(d) sprocket drive means for said belt (20);

(e) a crank operable worm gear set arranged to drive said sprocket drive means in response to turning of crankshaft (8);

(f) attachment means (24–27) to form a rigid attachment of said traveler (22) to a window sash; and (g) a floating loop (36) of resilient material configuring said belt (20) tending to retain a loop of said belt (20) about said idler puller (14).

15. A window operator characterized by (a) a track (2) having a longitudinal gap;

(b) a traveler (22) of elongated configuration slidably mounted in the gap of said track (2);

(c) a belt (20) mounted within said track (2) and attached to said traveler (22) so that motion of said belt causes sliding motion of said traveler (22);

(d) sprocket drive means for said belt (20);
(e) a crank operable worm gear set (28,29) arranged in a crankshaft housing (3) to drive said sprocket drive means in response to turning of a crankshaft (8);
(f) attachment means (24–27) to form a rigid attachment of said traveler (22) to a window sash; and
(g) means attaching said track (2) to said crankshaft housing (3) to help support said worm gear set (28,29);
whereby turning of a crank to operate said crank operable worm gear set opens and closes any attached window.

16. A window operator characterized by
(a) a track (2) having a longitudinal gap;
(b) a traveler (22) of elongated configuration slidably mounted in the gap of said track (2);
(c) a belt (20) mounted within said track (2) and attached to said traveler (22) so that motion of said belt causes sliding motion of said traveler (22);
(d) sprocket drive means for said belt (20) including a sprocket (19);
(e) a crank operable worm gear set arranged to drive said sprocket drive means in response to turning of a crankshaft (8);
(f) attachment means (24–27) to form a rigid attachment of said traveler (22) to a window sash; and
(g) means constraining said belt (20) about said sprocket by a set of bobbins (37) outside said belt (20) held against said belt (20) by a set of resilient rings (38).

17. A window operator characterized by
(a) a track (2) having a longitudinal gap;
(b) a traveler (22) of elongated configuration slidably mounted in the gap of said track (2);
(c) a belt (20) mounted within said track (2) and attached to said traveler (22) so that motion of said belt causes sliding motion of said traveler (22);
(d) sprocket drive means for said belt (20) including a sprocket (19);
(e) a crank operable worm gear set arranged to drive said sprocket drive means in response to turning of a crankshaft (8);
(f) attachment means (24–27) to form a rigid attachment of said traveler (22) to a window sash;
(g) means equipping said traveler (22) with a stud (35) and means fastening said belt (20) about said traveler by a resilient fastener (36) defining a loop (34) in said belt (20) capturing said stud (35); and
(h) said crankshaft (8) has E-clip grooves and is held in place by E-clips (31) in said grooves which serve as thrust control.

18. A window operator, for a window having an opening filled by one or more slidable sash units characterized by
(a) a track (2) of length similar to that of the window opening, having a generally closed configuration sprocket and belt chamber relieved by a longitudinal gap of defined dimension and smoothly configured gap-defining edges (4,5), the track having a base end and a distal end opposite said base end;
(b) a traveler (22) of general H-configuration captured slidingly in the defined gap of said track (2) and attachable to a window sash (23);
(c) an idler pulley (14) mounted near the distal end of said track (2), to rotate in a plane generally perpendicular to the sash of said window;
(d) a sprocket and belt set (19,20) mounted within said sprocket and belt chamber of said track (2), said sprocket and belt set (19,20) including a sprocket pulley (19) mounted near the base end of said track (2), to rotate within the sprocket and belt chamber of said track (2) in general alignment with said idler pulley (14), rotationally locked onto a sprocket shaft (21) which is supported for easy rotation by a bearing (17) on the exterior of said track (2) and extends through an assembly opening to the outside of said track (2);
(e) means mounting said traveler (22) to the sash (23) of said window;
(f) a crankshaft housing (3) mounted adjacent said track (2) to form a worm gear mechanism and sprocket chamber for said sprocket shaft (21) and its related gears (19,28,29), being an extrusion section having a base and seven sides, two of which form parallel crankshaft bearing faces (6,7) and have locating holes (31,32) for crankshaft bearings (17), and having a plurality of screw bosses (9);
(g) means mounting a crankshaft (8), with worm gear set (28,29) and one or more thrust bearings (17) holding said crankshaft longitudinally within said worm gear mechanism and sprocket chamber;
(h) crankshaft housing cover (33) providing location and thrust support for sprocket shaft (21) bearing (17); and
(i) means mounting said crankshaft housing (3) together with said track (2) in such relationship that, when assembled together with said sprocket shaft (21), belt (20) and sprocket (19) in place, said track (2) defines an opening (18) sufficient for entry of said sprocket (19) prior to final assembly of said sprocket, but has a shoulder for keeping said sprocket in place once assembled,
whereupon rotation of said crankshaft (8) provides via said worm gear set (28,29) and sprocket and belt set (19, 20) a selective sliding motion to traveler (22) and to sash (23).

19. A window operator, for a window having an opening filled by one or more slidable sash units characterized by
(a) a track (2) of length similar to that of the window opening, having a generally closed configuration sprocket and belt chamber relieved by a longitudinal gap of defined dimension and smoothly configured gap-defining edges (4,5), the track having a base end and a distal end opposite said base end;
(b) a traveler (22) of general H-configuration captured slidingly in the defined gap of said track (2) and attachable to a window sash (23);
(c) an idler pulley (14) mounted near the distal end of said track (2), to rotate in a plane generally perpendicular to the sash of said window;
(d) a sprocket and belt set (19,20) mounted within said sprocket and belt chamber of said track (2), said sprocket and belt set (19,20) including a sprocket pulley (19) mounted near the base end of said track (2), to rotate within the sprocket and belt chamber of said track (2) in general alignment with said idler pulley (14), rotationally locked onto a sprocket shaft (21) which is supported for easy rotation by a bearing (17) on the exterior of said track (2) and extends through an assembly opening to the outside of said track (2);
(e) means mounting said traveler (22) to the sash (23) of said window;

(f) a crankshaft housing (3) mounted adjacent said track (2) to form a worm gear mechanism and sprocket chamber for said sprocket shaft (21) and its related gears (19,28,29), being an extrusion section having a base and seven sides, two of which form parallel crankshaft bearing faces (6,7) and have locating holes (31,32) for crankshaft bearings (17), and having a plurality of screw bosses (9);

(g) means mounting a crankshaft (8), with worm gear set (28,29) and one or more thrust bearings (17) holding said crankshaft longitudinally within said worm gear mechanism and sprocket chamber;

(h) crankshaft housing cover (33) providing location and thrust support for sprocket shaft (21) bearing (17); and (i) means mounting said crankshaft (8) and said sprocket shaft (21) in place by permanently lubricated flanged plastic bushings (17) which bear against other parts permanently assembled on such shafts to serve as thrust bearings and as assembly aids;

whereupon rotation of said crankshaft (8) provides via said worm gear set (28,29) and sprocket and belt set (19, 20) a selective sliding motion to traveler (22) and to sash (23).

* * * * *